US006805310B2

(12) United States Patent
Yamashita

(10) Patent No.: US 6,805,310 B2
(45) Date of Patent: Oct. 19, 2004

(54) FUEL INJECTION DEVICE HAVING MAGNETIC CIRCUIT TO DRIVE MOVABLE CORE

(75) Inventor: Yoshinori Yamashita, Kariya (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/347,180

(22) Filed: Jan. 21, 2003

(65) Prior Publication Data

US 2003/0146308 A1 Aug. 7, 2003

(30) Foreign Application Priority Data

Jan. 18, 2002 (JP) ..... 2002-10211

(51) Int. Cl.[7] ..... B05B 1/30

(52) U.S. Cl. ..... 239/585.1; 239/585.4; 239/900; 251/129.21

(58) Field of Search ..... 239/585.1–585.5, 239/900, 129.16, 129.21; 251/129.01

(56) References Cited

U.S. PATENT DOCUMENTS

| | | | | |
|---|---|---|---|---|
| 4,007,880 A | * | 2/1977 | Hans et al. | 239/585.5 |
| 5,927,613 A | * | 7/1999 | Koyanagi et al. | 239/585.1 |
| 5,931,391 A | | 8/1999 | Tani et al. | |
| 5,967,419 A | * | 10/1999 | Yamaguchi et al. | 239/397.5 |
| 6,012,655 A | | 1/2000 | Maier | |

* cited by examiner

*Primary Examiner*—Dinh Q. Nguyen
(74) *Attorney, Agent, or Firm*—Nixon & Vanderhye P.C.

(57) ABSTRACT

In a fuel injection device, a metal inner tubular member has a step in an outer peripheral wall of the metal inner tubular member, and an axial end surface of an upstream end portion of a metal outer frame member axially abuts against the step of the metal inner tubular member.

8 Claims, 5 Drawing Sheets

FUEL INJECTION DEVICE HAVING MAGNETIC CIRCUIT TO DRIVE MOVABLE CORE

CROSS REFERENCE TO RELATED APPLICATION

This application is based on and incorporates herein by reference Japanese Patent Application No. 2002-10211 filed on Jan. 18, 2002.

BACKGROUND OF THE INVENTION

1. Field of the Invention:

The present invention relates to a fuel injection device.

2. Description of Related Art:

In one known fuel injection device (also known as a fuel injection valve or injector), for example, for an internal combustion engine of a vehicle, a valve arrangement is driven by an electromagnetic drive unit to open and close fuel injection holes at variable and adjustable timing to precisely control the amount of fuel being injected from the fuel injection device.

In such a fuel injection device, a resin molded member (hereinafter, referred to as a resin outer cover member), such as a resin mold, serves as a securing means for securing corresponding components of the electromagnetic drive unit to the valve arrangement. That is, the resin molded member covers the components of the electromagnetic drive unit and joins them to the valve arrangement (as described in Japanese Unexamined Patent Publication No. 11-70347 corresponding to U.S. Pat. No. 5,931,391).

According to the Japanese Unexamined Patent Publication No. 11-70347, a metal inner tubular member, which serves as a stationary iron core, and two pieces of yokes are welded together with a drive coil sandwiched therebetween. Furthermore, the resin outer cover member is designed to fill a gap between the two pieces of yokes and the coil.

In the conventional structure, the metal inner tubular member, which is a component common to both the electromagnetic drive unit and the valve arrangement, is welded to the yokes, which are the components of the electromagnetic drive unit. Thus, in the case of the resin molded assembly, in which the components of the electromagnetic drive unit and the metal inner tubular member are integrated by the resin outer cover member through resin molding, it is required to prevent intrusion of foreign debris and also to prevent falling off of the components in manufacturing. This leads to additional costs associated with the manufacturing control.

Japanese Unexamined Patent Publication No. 11-513101 corresponding to U.S. Pat. No. 6,012,655 discloses a fuel injection device that addresses this issue. That is, components of the electromagnetic drive unit, which are arranged radially outward of the metal inner tubular member, are integrally resin-molded, and the metal inner tubular member and other components of the valve arrangement are assembled separately from the resin-molded components of the electromagnetic drive unit.

However, a magnetically connecting structure between the metal inner tubular member and the yokes in the fuel injection device disclosed in the Japanese Unexamined Patent Publication No. 11-513101 provides a simple contact between the metal inner tubular member and the yokes. In some instances, such a magnetic circuit may have a gap, which leads to inferior magnetic property and a slower response time in closing and opening of the valve arrangement.

Furthermore, the market continues to demand lower cost combustion engines that are also capable of achieving higher output power. In order to respond to such a need, the fuel injection device, which is a part of the internal combustion engine, must also offer a faster response time for opening and closing of the valve at a lower product cost.

SUMMARY OF THE INVENTION

The present invention addresses the issue described above by providing a fuel injection device that achieves a reduced product cost and stable magnetic property of a magnetic circuit.

To achieve the objective of the present invention, there is provided a fuel injection device that includes a metal inner tubular member, a drive coil arrangement, a metal outer frame member and a resin outer cover member. The metal inner tubular member receives a movable core and a valve member, which are joined to each other. The movable core and the valve member axially reciprocate in the metal inner tubular member. The metal inner tubular member constitutes a part of a magnetic circuit, which drives the movable core. The drive coil arrangement includes a coil and a bobbin. The coil generates electromagnetic force upon energization of the coil to activate the magnetic circuit. The coil is wound around the bobbin. The metal outer frame member is arranged radially outward of the metal inner tubular member in such a manner that the drive coil arrangement is radially positioned between the metal inner tubular member and the metal outer frame member. An end portion of the metal outer frame member is engaged with the metal inner tubular member to form another part of the magnetic circuit. The resin outer cover member at least partially covers an outer peripheral surface of the metal outer frame member all around the metal outer frame member. The resin outer cover member is joined to and covers the coil and the metal outer frame member. The metal inner tubular member has a step in an outer peripheral wall of the metal inner tubular member. An axial end surface of the end portion of the metal outer frame member axially abuts against the step of the metal inner tubular member.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

A fuel injection device (also known as a fuel injection valve or injector) according to an embodiment of the present invention will be described with reference to the accompanying drawings.

Figure 1:
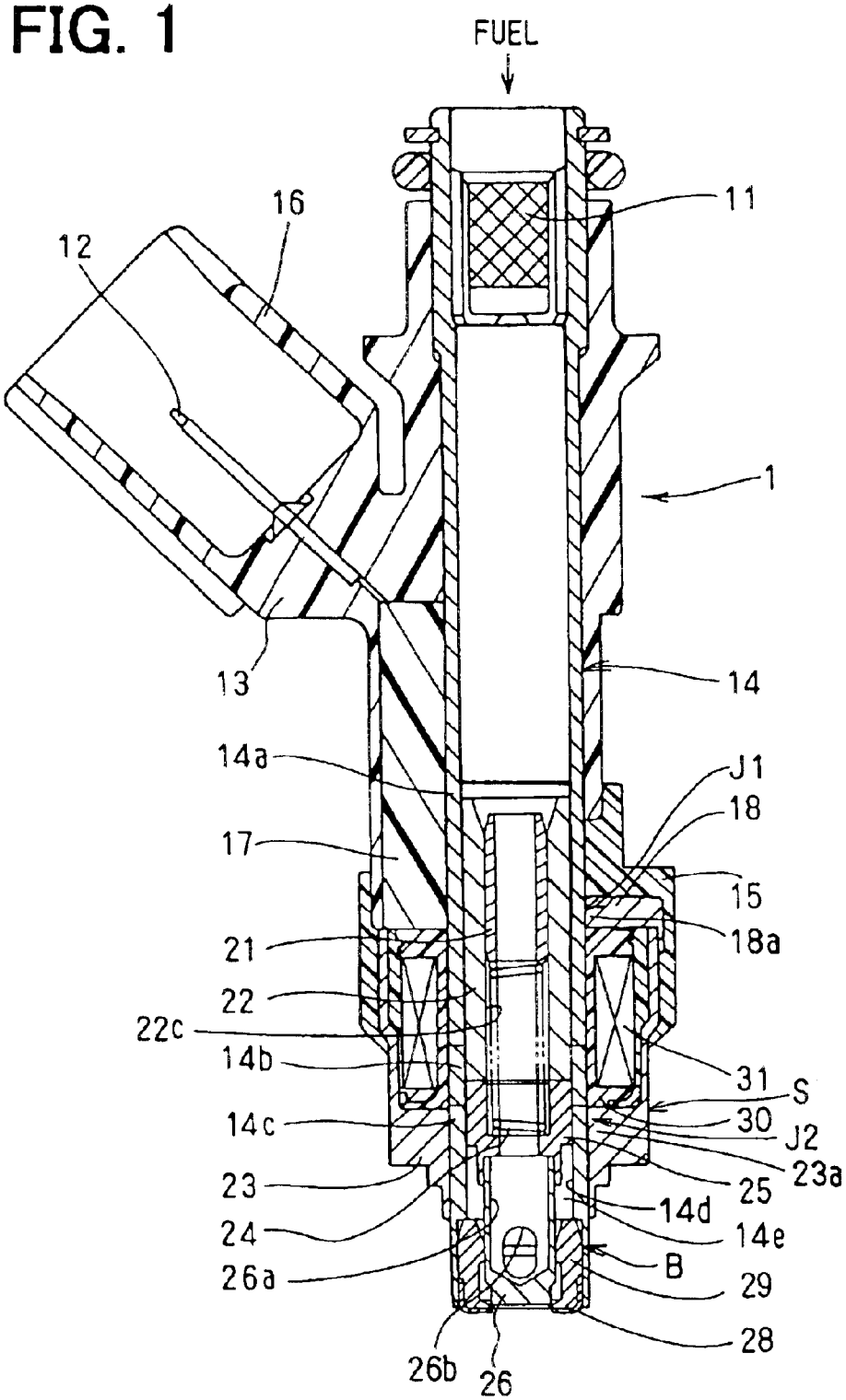
FIG. 1 is a cross sectional view schematically showing a structure of a fuel injection device according to an embodiment of the present invention.
Figure 2:
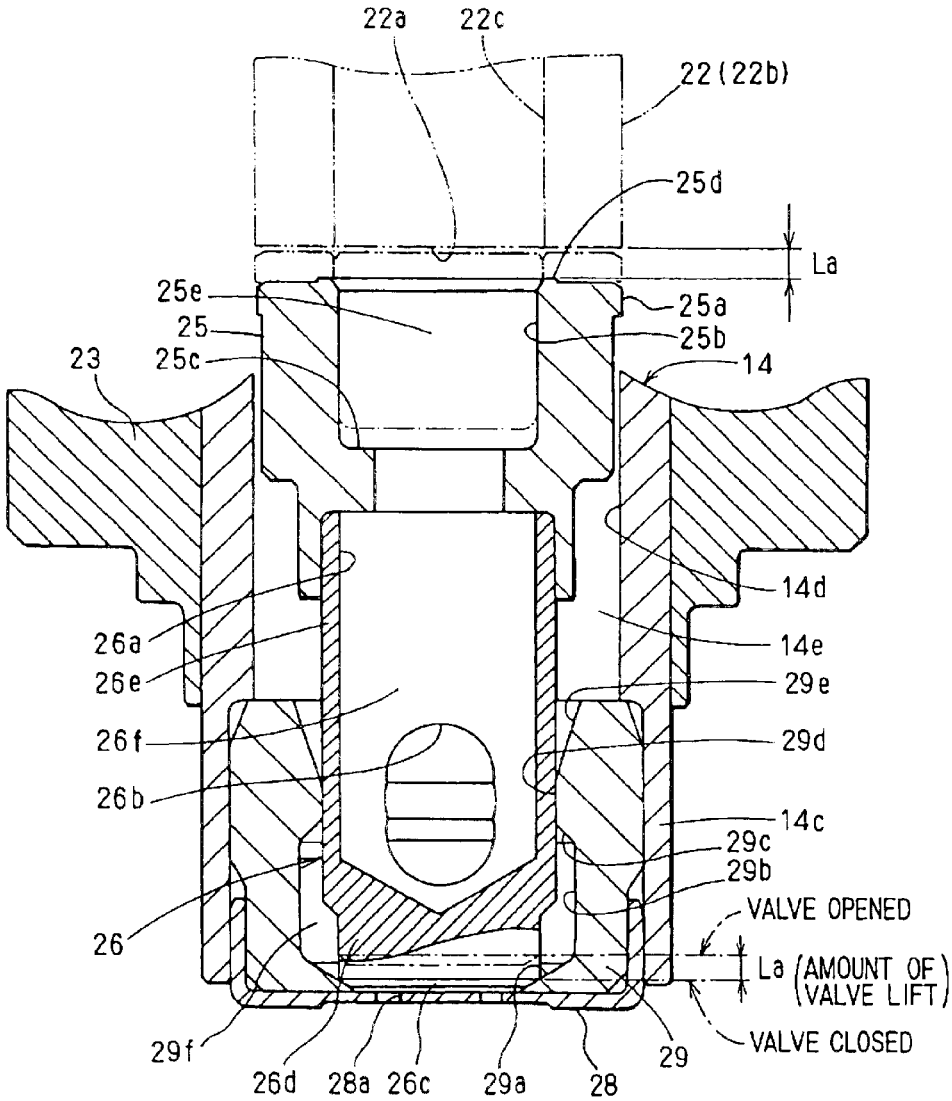
FIG. 2 is an enlarged partial cross sectional view showing a structure around a valve member of the fuel injection device shown in FIG. 1.

As shown in FIGS. 1 and 2, a fuel injection device 1 is used with an internal combustion engine and, more specifically, with a gasoline engine. The fuel injection device 1 is installed to an intake pipe of the internal combustion engine to supply fuel to a corresponding combustion chamber of the internal combustion engine by injecting fuel. An overall shape of the fuel injection device 1 is generally cylindrical. The fuel injection device 1 includes a valve body 29, a valve member (hereinafter referred to as a needle valve) 26, a bobbin 30, a coil 31, first and second metal outer frame members 18, 23, an attracting member (also referred to as a stationary core) 22, a metal inner tubular member 14 and an armature 25. The valve body 29 and the valve member 26 cooperate together to serve as a valve arrangement B. The coil 31 is wound around the bobbin 30 and serves as a drive coil. The coil 31 and the bobbin 30 cooperate together to serve as a drive coil arrangement of the present invention. The metal outer frame members 18, 23, the attracting member 22 and the metal inner tubular member 14 form a magnetic circuit, through which a magnetic flux flows upon energization of the coil 31. The armature 25 serves as a movable core that is axially movable by attracting force created by the magnetic flux. The coil 31 wound around the bobbin 30, the metal outer frame members 18, 23, the attracting member 22, the metal inner tubular member 14 and the armature 25 cooperate together to serve as an electromagnetic drive unit S.

The valve body 29, which forms a part of the valve arrangement B, and the needle valve 26, which serves as the valve member, will be described first. First, it should be noted that the valve arrangement B is not limited to the above arrangement and is only required to include an injection hole plate 28, which has fuel injection holes 28*a*, at an exit of a fuel passage formed at a downstream end of the valve body 29, and to meter fuel by injecting fuel from the injection holes 28*a*.

The valve body 29 is secured to an inner peripheral wall of the metal inner tubular member 14 by welding. More specifically, as shown in FIG. 2, the valve body 29 is constructed to be inserted into or press fitted to a first magnetic tubular segment 14*c* of the metal inner tubular member 14. The valve body 29, inserted into the first magnetic tubular segment 14*c*, is welded all the way around from the outer side of the first magnetic tubular segment 14*c*.

A tapered annular surface section 29*a* is provided in an inner peripheral wall surface of the valve body 29. The tapered annular surface section 29*a* serves as a valve seat, against which the needle valve 26 is seatable. More specifically, as shown in FIG. 2, a fuel passage for conducting fuel to be injected into the combustion engine is formed inside the valve body 29. The inner peripheral wall surface of the valve body 29 includes the tapered annular surface section 29*a*, a large diameter cylindrical surface section 29*b*, a tapered annular surface section 29*c*, a small diameter cylindrical surface section 29*d* and a tapered annular surface section 29*e*, which are arranged in this order from a downstream end of the valve body 29 toward the upstream end of the valve body 29. The small diameter cylindrical surface section 29*d* slidably supports the needle valve 26. The tapered annular surface 29*a*, i.e., the valve seat 29*a* is tapered to have a reducing inner diameter that is progressively reduced toward the downstream end of the valve body 29. An abutting portion 26*c* of the need valve 26 (described later in greater detail) engages and disengages the valve seat 29*a* to close and open the injection holes 28*a*. The large diameter cylindrical surface section 29*b* forms a fuel pressure chamber 29*f* in cooperation with the needle valve 26. The small diameter cylindrical surface section 29*d* forms a needle support hole that slidably supports the needle valve 26. The needle support hole has an inner diameter smaller than an inner diameter of the large diameter cylindrical surface section 29*b*. The tapered annular surfaces section 29*e* has an increasing inner diameter that is progressively increased toward the upstream side of the valve body 29.

The valve seat 29*a*, the large diameter cylindrical surface section 29*b*, the tapered annular surface section 29*c*, the small diameter cylindrical surface section 29*d* and the tapered annular surface section 29*e* form a guide hole, which receives the needle valve 26, in cooperation with the inner peripheral surface of the metal inner tubular member 14 (described later in greater detail).

The needle valve 26, which serves as the valve member, is shaped as a generally cylindrical body having a bottom and is made of stainless steel. The abutting portion 26*c*, which can be engaged and disengaged with respect to the valve seat 29*a*, is formed at the downstream end of the needle valve 26. More specifically, as shown in FIG. 2, the needle valve 26 includes a small diameter cylindrical portion 26*d* and a large diameter cylindrical portion 26*e*, which are arranged in this order from the downstream end of the needle valve 26. The small diameter cylindrical portion 26*d* has an outer diameter smaller than that of the large diameter cylindrical portion 26*e*. The large diameter cylindrical portion 26*e* is slidably supported by the inner peripheral surface of the valve body 29 (specifically, the small diameter cylindrical surface section 29*d*). An outer peripheral edge of a downstream end of the small diameter cylindrical portion 26*d* is chamfered to have a tapered annular surface, which forms the abutting portion 26*c*. Thus, an outer diameter of the abutting portion 26*c*, i.e., a seat diameter of the abutting portion 26*c* is smaller than the inner diameter of the needle support hole defined by the small diameter cylindrical surface section 29*d*. This structure allows precise machining of the valve seat 29*a*, to which the abutting portion 26*c* is engageable. This structure also ensures sealing between the valve seat 29*a* and the abutting portion 26*c* during a valve closing period. Because the seat diameter is smaller than the inner diameter of the needle support hole defined by the small diameter cylindrical surface section 29*d* of the valve body 29, a seat part of the valve seat 29*a* can be machined precisely, for example, by inserting a cutting blade from the upstream side into the fuel pressure chamber 29*f* to ensure the tight valve sealing, after the small diameter cylindrical surface section 29*d*, the tapered annular surface section 29*c*, the large diameter cylindrical surface section 29*b* and the valve seat 29*a* are formed by cutting inside the valve body 29. The large diameter cylindrical portion 26*e* is arranged on the upstream side of the needle valve and is shaped into a cylinder having an outer diameter that is slightly smaller than the inner diameter of the small diameter cylindrical surface section 29*d* of the valve body 29 to slide along the small diameter cylindrical surface section 29*d*. With the above arrangement, a small gap of a predetermined size is created between the outer peripheral surface of the large diameter cylindrical portion 26*e* and the small diameter cylindrical surface section 29*d* to allow sliding engagement therebetween.

A majority of the large diameter cylindrical portion 26*e* has a thin cylindrical wall. As shown in FIG. 2, an inner peripheral wall 26*a* of the large diameter cylindrical portion 26*e* defines an inner passage 26*f*, through which the fuel flows toward the fuel injection holes 28*a*. The inner passage 26*f* is formed, for example, by boring a hole through the upstream end surface of the large diameter cylindrical portion 26*e*. A depth of the bored hole is chosen such that a bottom wall portion of the needle valve 26 can stand mechanical shocks generated when the abutting portion 26*c* is seated against the valve seat 29*a*.

As a result, the needle valve 26 can have a reduced weight and enough mechanical strength to withstand the shocks generated when the abutting portion 26*c* is seated against the valve seat 29*a*. Because of the reduced weight of the needle valve 26, the response of the valve arrangement B is improved.

At least one exit hole 26*b* is formed in a downstream region of the inner passage in the large diameter cylindrical portion 26*e* to allow conduction of fuel to the valve seat 29*a*, i.e., the fuel pressure chamber 29*f*.

The injection hole plate 28 is formed in a shape of a thin plate at the downstream end of the fuel injection device 1 and includes the injection holes 28*a* at the center. A layout and an orientation of the injection holes 28*a* determine the direction of fuel injection, and the size of the injection holes 28*a* and the opening and closing timing of the valve arrangement B, which is driven by the electromagnetic drive unit S, determine the amount of fuel injected from the injection holes 28*a*.

The coil 31, the metal inner tubular member 14, the attracting member 22, the metal outer frame members 18, 23 and the armature 25 will be described.

As shown in FIG. 1, the coil 31, which serves as the drive coil, is wound around the bobbin 30, made of a resin material. A terminal 12 is electrically connected to an end of the coil 31. The bobbin 30 is mounted around the metal inner tubular member 14. A connector 16 protrudes from an outer peripheral wall of a resin mold 13 formed around the metal inner tubular member 14. The terminal 12 is embedded in the connector 16.

The metal inner tubular member 14 is a tubular component, which has magnetic segments and a non-magnetic segment and is made, for example, of a compound magnetic material. A portion of the metal inner tubular member 14 is demagnetized by heating, so that the first magnetic tubular segment 14*c*, a non-magnetic tubular segment 14*b* and a second magnetic tubular segment 14*a* are formed in this order from the downstream end of the metal inner tubular member 14 toward the upstream end of the metal inner tubular member 14 (from the lower end to the upper end in FIG. 1). An inner peripheral wall 14*d* of the metal inner tubular member 14 defines an armature receiving hole 14*e*. The armature 25, which will be described later, is received in the armature receiving hole 14*e* and is positioned adjacent to a border between the non-magnetic tubular segment 14*b* and the first magnetic tubular segment 14*c*.

With reference to FIG. 1, at the outer periphery of the metal inner tubular member 14, the metal outer frame members 18, 23 are opposed to each other about the coil 31, and the resin mold 15 covers the metal outer frame members 18, 23. More specifically, the second metal outer frame member 23 covers the outer periphery of the coil 31, and the first metal outer frame member 18 is arranged on the upstream side of the coil 31 and partially extends around the coil 31 to cover the outer periphery of the coil 31 without overlapping with a rib 17. The resin mold 15 is formed around the metal frame members 18, 23 and is connected to the resin mold 13.

With the above arrangement, an electromagnetic circuit, through which a magnetic flux flows upon energization of the coil 31, is formed. In the electromagnetic circuit, the magnetic flux flows through the second magnetic tubular segment 14*a*, the attracting member 22, the armature 25, the first magnetic tubular segment 14*c*, the second metal outer frame member 23 and the first metal outer frame member 18 in this order.

A connecting structure that connects the metal inner tubular member 14 to the metal outer frame members 18, 23 will be described later.

The armature 25 is shaped as a generally cylindrical body having a step and is made of a ferromagnetic material, such as magnetic stainless. The armature 25 is secured to the needle valve 26. When the coil 31 is energized, a magnetic flux created by electromagnetic force in the coil 31 acts on the armature 25 through the attracting member 22. Thus, the armature 25 and the needle valve 26 axially move toward the attracting member 22, i.e., axially move away from the valve seat 29*a*. An inner space 25*e* in the armature 25 communicates with the inner passage 26*f* of the needle valve 26.

The armature 25 includes a protruding portion 25*d* in an upstream end surface of the armature 25, which faces the attracting member 22. The protruding portion 25*d* minimizes the contact surface area between the armature 25 and the attracting member 22. Thus, at the time of valve closing movement, when the coil 31 is deenergized, the armature 25, which has been attracted to and has been engaged with the attracting member 22, can be quickly demagnetized. In this way, the valve closing response is improved.

The attracting member 22 is shaped as a generally cylindrical body and is made of a ferromagnetic material, such as magnetic stainless. The attracting member 22 is secured to the inner peripheral wall 14*d* of the metal inner tubular member 14, for example, by press fitting the attracting member 22 to the inner peripheral wall 14*d*. An amount of valve lift La, as shown in FIG. 2, can be adjusted by adjusting an axial position of the attracting member 22 along the inner peripheral wall 14*d* of the metal inner tubular member 14.

An urging spring (compression spring) 24 is placed between an end surface of an adjusting pipe 21 (described later) and a spring seat 25*c* of the armature 25, which is a stepped portion that defines an inner space 25*e* of the armature 25. The spring 24 exerts a predetermined urging force to urge the armature 25 toward the valve body 29 such that when the coil 31 is not energized, the spring 24 urges the needle valve 26 secured to the armature 25 against the valve body 29 (more specifically, the spring 24 urges the abutting portion 26*c* against the valve seat 29*a*) to close the injection holes 28*a*.

The adjusting pipe 21 is press fitted to the inner peripheral wall 22*c* of the attracting member 22. The urging force of the compression spring 24 can be adjusted to the predetermined urging force by adjusting an amount of insertion of the adjusting pipe 21 in the attracting member 22. As long as the adjusting pipe 21 is capable of adjusting the urging force being applied for seating the needle valve 26 against the valve seat 29*a*, the adjusting pipe 21 is not necessarily limited to the one, which is press fitted to the inner peripheral wall 22*c* of the attracting member 22. For example, the adjusting pipe 21 may be press fitted to the inner peripheral wall of the fuel injection device 1, such as the inner peripheral wall of the metal inner tubular member 14, which defines the fuel passage. Alternatively, the adjusting pipe 21 may be threadably secured to the inner peripheral wall 22*c* of the attracting member 22.

In the present embodiment, it is assumed that the adjusting pipe 21, which serves as an adjusting bush for adjusting the urging force, is secured by press fitting to the inner peripheral wall 22*c* of the attracting member 22, which serves as the inner peripheral wall of the fuel injection device 1.

The valve body 29 and the injection hole plate 28 are received in a downstream end of the metal tubular member 14 in a fluid tight manner. Alternatively, the injection hole plate 28 may be fluid-tightly welded to the valve body 29, and the valve body 29 may be fluid-tightly received in the metal inner tubular member 14. With reference to FIG. 1, a filter 11 is arranged in an upstream end (upper end in FIG. 1) of the metal inner tubular member 14. The filter 11 removes debris contained in fuel supplied to the fuel injection device 1.

The metal inner tubular member 14 is secured to the valve body 29 in an oil tight manner. The metal inner tubular member 14 and the valve body 29 define the guide hole that receives the needle valve 26. Therefore, the metal inner tubular member 14 also serves as a part of the valve body 29.

The operation of the fuel injection device 1 will be described.

When the drive coil 31 of the electromagnetic drive unit S is energized, electromagnetic force is created in the coil 31. At that time, a magnetic flux, which results from the electromagnetic force generated in the coil 31, flows through the metal inner tubular member 14 (more specifically, the magnetic tubular segments 14*a*, 14*c*), the metal outer frame members 18, 23 and the attracting member 22 to activate the magnetic circuit. Thus, an attracting force for attracting the armature 25 is generated in the attracting member 22. Therefore, the needle valve 26, which is secured to the armature 25, is lifted away from the valve seat 29*a* of the valve body 29. As a result, the needle valve 26 opens the injection holes 28*a*, and fuel flows through the armature receiving hole 14*e* and the inner passage 26*f* and is discharged through the injection holes 28*a*.

On the other hand, when the coil 31 is deenergized, the electromagnetic force generated in the coil 31 disappears, and thus the attracting force, which attracts the armature 25 toward the attracting member 22, also disappears. Thus, the needle valve 26 is urged against the valve seat 29*a* of the valve body 29 by the compression spring 24. As a result, the needle valve 26 is seated against the valve body 29 to close the injection holes 28*a* to stop injection of the fuel. At that time, when the closed state of valve arrangement B (specifically, the sealed state at the time of seating the abutting portion 26*c* of the needle valve 26 against the valve seat 29*a*) is tight, outflow of the fuel can be relatively accurately stopped.

In this way, the fuel injection device 1 is able to relatively precisely adjust the amount of fuel injected to the internal combustion engine by varying an energizing period, i.e., a valve opening time period.

A highly precise control over the amount of fuel injection would only be possible by achieving desired valve opening characteristic (e.g., opening of the valve arrangement B for a desired valve opening time period) through energization and deenergization of the electromagnetic drive unit S. Thus, to achieve this, it is required to achieve a stable magnetic property of the magnetic circuit. Here, achievement of the stable magnetic property means elimination of a substantial gap, which could deteriorate the magnetic property, in the magnetic circuit.

Thus, in the present embodiment, the stable magnetic property of the magnetic circuit and the reduced manufacturing cost of the fuel injection device 1 are achieved without causing a substantial loss of the magnetic property with the following characteristic features.

First, the electromagnetic drive unit S, specifically, the connecting structure between the metal inner tubular member 14 and the metal outer frame members 18, 23 will be described with reference to FIGS. 3 and 4.

Figure 3:
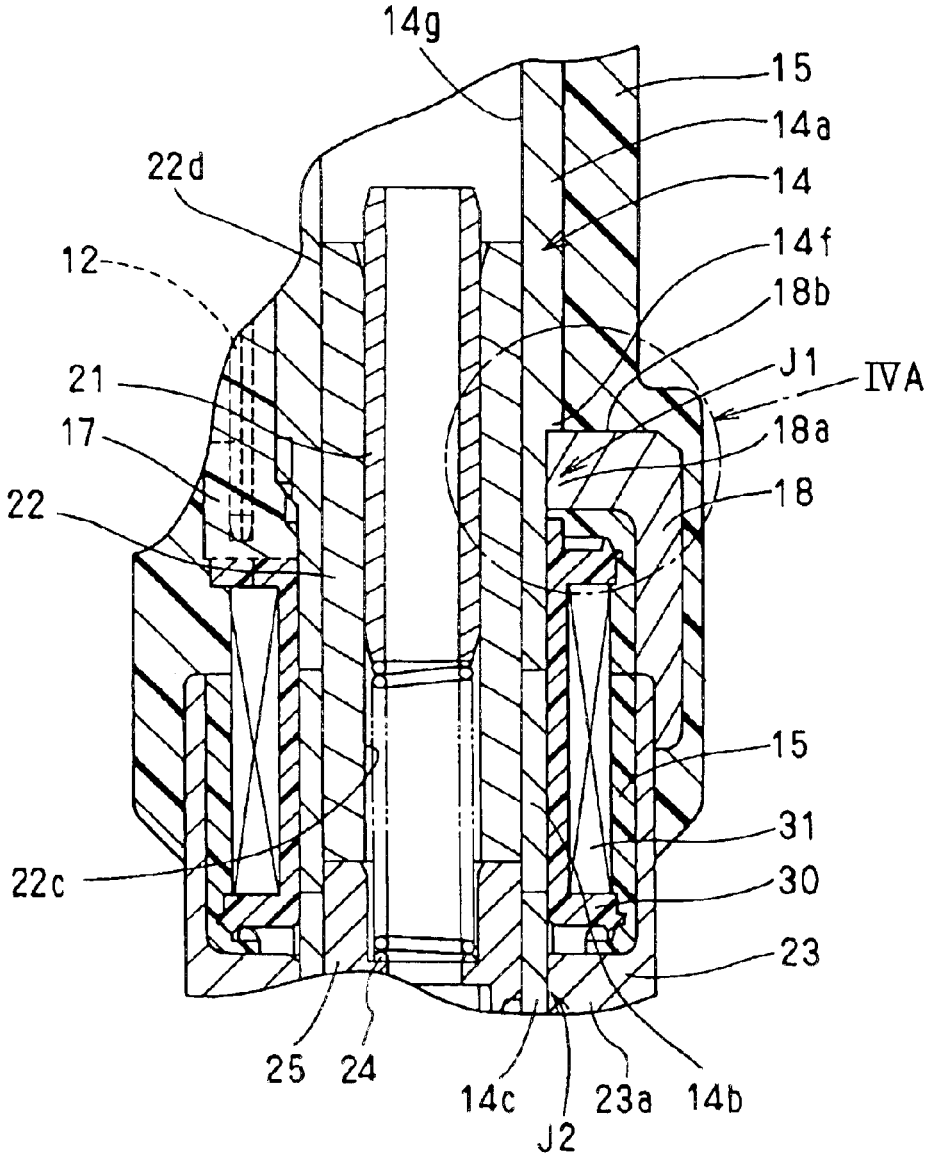
FIG. 3 is an enlarged partial cross sectional view showing a structure of an electromagnetic drive unit of the fuel injection device shown in FIG. 1.

With reference to FIG. 3, a first junction J1 is formed between the metal inner tubular member 14 and an upstream end portion 18*a* of the first metal outer frame member 18. Also, a second junction J2 is formed between the metal inner tubular member 14 and an annular portion 23*a* of the second metal outer frame member 23. The junctions J1, J2 serve as junctions of the magnetic circuit. Furthermore, the junctions J1, J2 are only required to achieve a magnetic connection between the metal inner tubular member 14 and the upstream end portion 18*a* as well as the annular portion 23*a* such that a magnetic flux generated upon energization of the drive coil 31 drives the armature 25.

Furthermore, the junctions J1, J2 can be constructed as follows. Here, for the sake of simplicity, only the junction 1 will be discussed. The metal inner tubular member 14 and the upstream end portion 18*a* may be arranged to contact each other and may be securely covered by the resin outer cover member 15 to form the first junction J1. Alternatively, the metal inner tubular member 14 and the upstream end portion 18*a* may be welded together to form the first junction J1. Further alternatively, the upstream end portion 18*a* may be press fitted to the metal inner tubular member 14 to form the first junction J1. In this way, unlike the simple contact between the metal inner tubular member 14 and the upstream end portion 18*a*, the magnetic connection between the metal inner tubular member 14 and the upstream end portion 18*a* can be maintained through the junction J1 formed by any one of the above manners without making a substantial gap between the metal inner tubular member 14 and the upstream end portion 18*a*.

The construction of the junction by the press fitting is advantageous over the other two discussed above in terms of the manufacturing cost. More specifically, in the case of the press fitting, the metal outer frame members 18, 23, the bobbin 30 and the coil 30 can be integrated together as an integral resin-molded assembly by molding the resin outer cover members 13, 15 over the metal outer frame members 18, 23, the bobbin 30 and the coil 30. Then, the metal inner tubular member 14, the valve arrangement B and other relevant components can be assembled separately from the integral resin-molded assembly and then assembled to the integral resin-molded assembly. For example, in one possible case, the valve body 29, the injection hole plate 28, the valve member 26, the armature 25, the attracting member 22, the adjusting pipe 21, the spring 24 and the filter 11 can be first installed to the metal inner tubular member 14, and this metal inner tubular member 14 can be press fitted into the integral resin-molded assembly. This allows a reduction of the manufacturing cost. For example, in the manufacturing of the fuel injection device 1, components of the fuel injection device 1 manufactured at a component processing step are transferred to an assembling step where the components are assembled. During the transferring step of the components from the component processing step to the assembling step, no specialized measures are required to achieve air tightness of the components for preventing intrusion of foreign debris and for preventing falling off of the components. Thus, the manufacturing cost can be reduced.

In the following description, it is assumed that the first and second junctions J1, J2 are formed by the press fitting, i.e., the upstream end portion 18*a* is press fitted to the metal inner tubular member 14 (specifically, to the second magnetic tubular segment 14*a*), and the annular portion 23*a* is press fitted to the metal inner tubular member 14 (specifically, to the first magnetic tubular segment 14*c*). As long as the configuration of the upstream end portion 18*a* does not prevent the press fitting of the upstream end portion 18*a* to the metal inner tubular member 14, the upstream end portion 18 is not necessarily have an annular shape to surround the outer periphery of the second magnetic tubular segment 14*a*. For example, the upstream end portion 18*a* can have a sectoral cross section (i.e., a fan shaped cross section) that only partially covers the outer periphery of the second magnetic tubular segment 14*a* without overlapping with the rib 17.

Furthermore, the metal inner tubular member 14 has a step 14*f*, to which an upstream end surface 18*b* of the first metal outer frame member 18 is engaged. With this arrangement, when the metal outer frame members 18, 23 and the drive coil 31 are installed to the metal inner tubular member 14 in the axial direction from the downstream side to the upstream side of the fuel injection device 1, axial positioning of the metal outer frame members 18, 23 and the drive coil 31 can be relatively easily performed to allow relatively easy axial installation.

In the present embodiment, the upstream end surface 18*b* of the upstream end portion 18*a* abuts against the step 14*f*.

It is relatively easy to form a closely contacted surface between the step 14*f* and the upstream end surface 18*b*, so that a substantial gap is not formed between the step 14*f* and the upstream end surface 18*b*, and thus the magnetic circuit with the stable magnetic property can be provided.

As a result, in the present embodiment, the press fitting and the axial abutment are used, so that magnetic connection between the upstream end portion and the metal inner tubular member is effectively maintained by the closely engaged state.

Figure 4A:
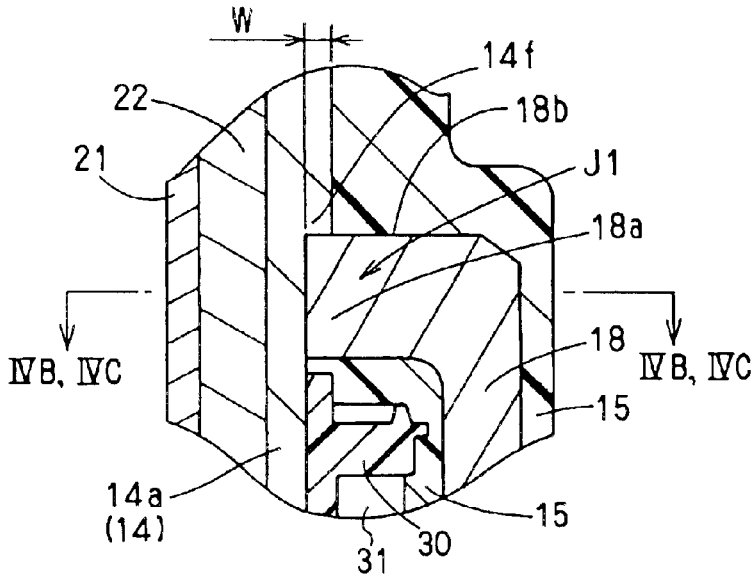
FIG. 4A is an enlarged view of an area indicated by a circle IVA in FIG. 3.
Figure 4B:
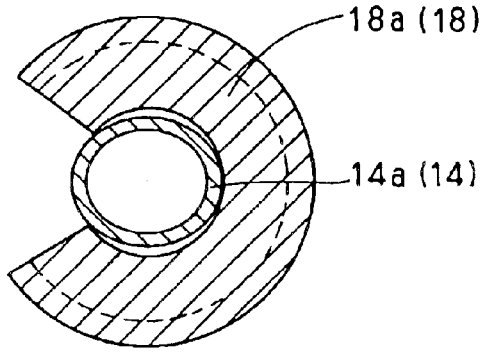
FIG. 4B is a cross sectional view along line IVB—IVB in FIG. 4A showing a metal inner tubular member that has an elliptical cross section.
Figure 4C:
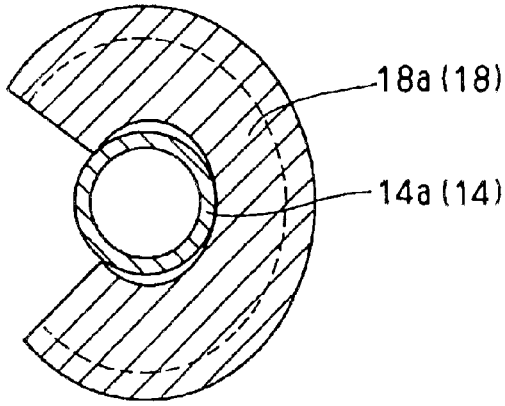
FIG. 4C is a cross sectional view along line IVC—IVC in FIG. 4A showing a metal outer frame member that has an elliptical cross section.

The present embodiment is applicable to cases shown in FIGS. 4B and 4C to achieve a stable magnetic property of the magnetic circuit and to achieve the reduced manufacturing cost.

FIG. 4A is an enlarged view of an area indicated by a circle IVA in FIG. 3 showing a structure around the junction J1 where the step 14*f* of the metal inner tubular member 14 and the upstream end portion 18*a* are engaged with each other. FIG. 4B is a cross sectional view along line IVB—IVB in FIG. 4A showing a case where the metal inner tubular member 14 is made of a relatively low price tubular material and thus has an elliptical outer cross section rather than a circular cross section. FIG. 4C is another cross sectional view along line IVC—IVC in FIG. 4A showing another case where the upstream end portion 18*a*, i.e., the first metal outer frame member 18 is formed through press working, which is considered to be relatively low cost process, and thus has an elliptical inner cross section. It should be noted that FIGS. 4B and 4C only show the exemplary cases that represent effects of deviations in the shapes of the metal inner tubular member 14 and of the upstream end portion 18*a*, and the outer peripheral surface of the metal inner tubular member 14 and the inner peripheral surface of the upstream end portion 18*a*, which constitute the junction J1 formed by the press fitting, may have elliptical shape or the like due to the effects of deviation from the corresponding ideal accurate shape.

As shown in FIGS. 4B and 4C, it is difficult to achieve a relatively high degree of circularity of the cross section of each of the metal inner tubular member 14 and the upstream end portion 18*a*, which are connected to each other through press fitting. Thus, it is difficult to achieve close contact between the metal inner tubular member 14 and the upstream end portion 18*a* along the entire circumference (in FIGS. 4B and 4C, the metal inner tubular member 14 and the upstream end portion 18*a* contact with each other at three points along the circumference). Thus, the magnetic flux generated by the coil 31 is concentrated in regions where the close contact is made between the metal inner tubular member 14 and the upstream end portion 18*a*, and the magnetic flux is difficult to flow through regions where the close contact is not made between the metal inner tubular member 14 and the upstream end portion 18*a*. Contrary to this, in the present embodiment, the structure, which achieves the press fitting and the abutment, is used to connect between the metal inner tubular member 14 and the upstream end portion 18*a*. That is, the structure, which achieves the abutment between the step 14*f* of the metal inner tubular member 14 and the upstream end surface 18*b* of the upstream end portion 18*a*, is used, so that the step 14*f* of the metal inner tubular member 14 and the upstream end surface 18*b* of the upstream end portion 18*a* can make close contact along the entire periphery to provide the stable magnetic property. Thus, the stable magnetic property of the magnetic circuit and the reduced manufacturing cost can be both achieved.

The inner peripheral wall of each of the resin outer cover members 13, 15, which are connected to and cover the coil 31 and the metal outer frame members 18, 23, is coaxial with an inner peripheral wall of the bobbin 30 and inner peripheral walls of the end portions 18*a*, 23*a* and has an inner diameter, which allows engagement of the inner peripheral wall of each of the resin outer cover members 13, 15 to the outer peripheral surface of the metal inner tubular member 14.

With this arrangement, the drive coil 31 and the metal outer frame members 18, 23, to which the resin outer cover members 13, 15 are connected to cover them, only need to securely fit to the metal inner tubular member 14 during the assembling step of the fuel injection device 1, so that the reduction of the manufacturing cost can be achieved. Furthermore, in the manufacturing, during the transferring step of the components from the component processing step to the assembling step, no specialized measures are required to achieve air tightness of the components for preventing intrusion of foreign debris and for preventing falling off of the components. Thus, the manufacturing cost can be reduced.

At the assembling step, the metal outer frame member 18 is engaged with the step 14 of the metal inner tubular member 14 through the upstream end surface 18*b* of the upstream end portion 18*a*.

With this arrangement, the assembly of the fuel injection device 1 at the assembling step is eased. For example, the coil 31 and the metal outer frame members 18, 23, to which the resin outer cover members 13, 15 are connected to cover them, can be axially positioned relative to the metal inner tubular member 14, in which the valve arrangement B is installed. This allows easy insertion installation of the metal inner tubular member 14, which has the valve arrangement B installed therein, to the coil 31 and the metal outer frame members 18, 23.

The above embodiment can be modified as follows.

Figure 5:
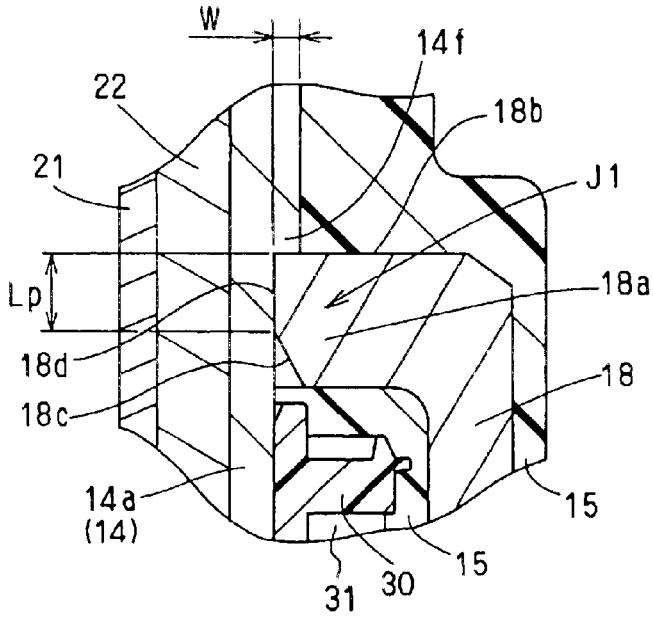
FIG. 5 is an enlarged partial cross sectional view similar to FIG. 4A showing a modification of the fuel injection device.

At the junctions J1, J2 where the press fitting is carried out, a portion of the inner peripheral surface of the upstream end portion 18*a* can have a tapered surface section 18*c*, along which an inner diameter of the upstream end portion 18*a* is progressively increased from an upstream end side of the upstream end portion 18*a* toward a downstream end of the upstream end portion 18*a*, as shown in FIG. 5.

With this modification, while the wall thickness of upstream end portion 18*a* is maintained to be a predetermined wall thickness to keep enough rigidity of the metal outer frame member 18, an axial length Lp of an engaging inner peripheral wall section 18*d* of the upstream end portion 18*a*, which is press fitted to the outer peripheral surface of the metal inner tubular member 14, is limited to a predetermined length. With this arrangement, the abutting of the upstream end surface 18*b* of the upstream end portion 18*a* to the step 14*f* of the metal inner tubular member 14 is eased in the assembling step. This allows improvements in the productivity, particularly in the assembling.

Furthermore, the limitation of the axial length Lp of the engaging inner peripheral wall section 18*d* of the upstream end portion 18*a* allows a reduction in a press fitting load applied to the metal inner tubular member 14 through the upstream end portion 18*a*. This restrains reduction of accuracy of the shape of the inner peripheral wall 14*d* of the metal inner tubular member 14, which could be induced by press fitting at the junction J1.

Figure 6:
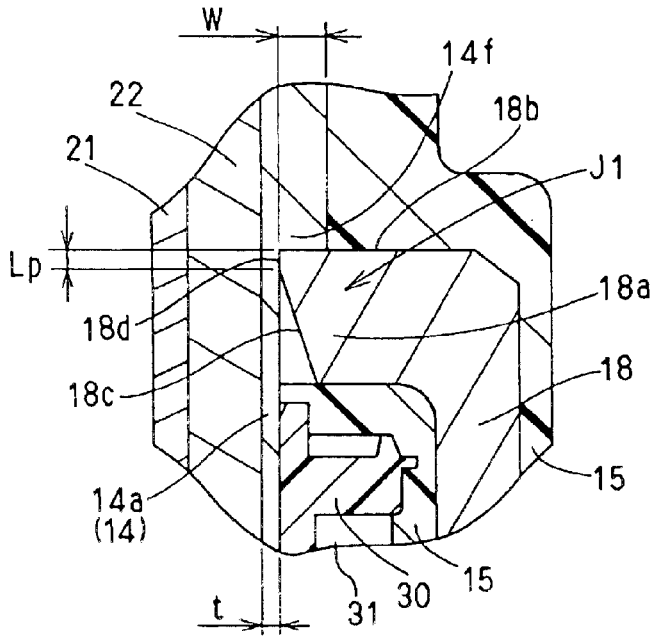
FIG. 6 is an enlarged partial cross sectional view similar to FIG. 4A showing another modification of the fuel injection device.

As another modification, the axial length Lp of the engaging inner peripheral wall section 18*d* of the upstream end portion 18*a* can be further reduced, as shown in FIG. 6. With this arrangement, the step 14*f* can be formed by further reducing the wall thickness (specifically, a thickness t in FIG. 6) of the single tubular component, which is made of the compound magnetic material (specifically, the magnetic tubular segments 14*a*, 14*c* and the non-magnetic tubular segment 14*b*), as shown in FIG. 6.

With this arrangement, the inner peripheral wall surface of the upstream end portion 18*a* has the tapered surface section 18*c*, along which an inner diameter of the upstream end portion 18*a* is progressively increased from the upstream end side of the upstream end portion 18*a* toward the downstream end of the upstream end portion 18*a*, as shown in FIG. 6. Thus, by changing the axial length Lp of the engaging inner peripheral wall section 18*d* of the upstream end portion 18*a*, a press fitting load can be adjusted. Thus, the connecting structure for the press fitting and the reduction of the wall thickness of the tubular member can be both achieved.

By reducing the wall thickness t of the portion of the metal inner tubular member 14, to which the upstream end portion 18*a* is press fitted, a radial width W of the abutting surface between the upstream end surface 18*b* of the upstream end portion 18*a* and the step 14*f* of the inner tubular member 14 can be increased without substantially increasing a size of the fuel injection device 1.

In the above embodiment, only the metal inner tubular member 14 and the first metal outer frame member 18, which form the junction J1 are discussed. However, in the case where the coil 31 and the metal outer frame members 18, 23 are integrated and covered by the resin outer cover members 13, 15 through insert molding, it should be understood that the above arrangements is applicable to the junction structure (second junction J2) for connecting between the annular portion 23*a* of the second metal outer frame member 23 and the metal inner tubular member 14 that has the step 14*f*.

Additional advantages and modifications will readily occur to those skilled in the art. The invention in its broader terms is therefore, not limited to the specific details, representative apparatus, and illustrative examples shown and described.

What is claimed is:

1. A fuel injection device comprising:

a metal inner tubular member that receives a movable core and a valve member, which are joined to each other, wherein the movable core and the valve member axially reciprocate in the metal inner tubular member, and the metal inner tubular member constitutes a part of a magnetic circuit, which drives the movable core;

a drive coil arrangement that includes:

a coil which generates electromagnetic force upon energization of the coil to activate the magnetic circuit; and a bobbin around which the coil is wound; and a metal outer frame member that is arranged radially outward of the metal inner tubular member in such a manner that the drive coil arrangement is radially positioned between the metal inner tubular member and the metal outer frame member, wherein an end portion of the metal outer frame member is engaged with the metal inner tubular member to form another part of the magnetic circuit; and a resin outer cover member that at least partially covers an outer peripheral surface of the metal outer frame member which is all around the metal outer frame member, wherein the resin outer cover member is joined to and covers the coil and the metal outer frame member, wherein:

the metal inner tubular member has a step in an outer peripheral wall of the metal inner tubular member; and an upstream axial end surface of the end portion of the metal outer frame member axially abuts against the step of the metal inner tubular member.

2. A fuel injection device wherein comprising:

a metal inner tubular member that receives a movable core and a valve member, which are joined to each other, wherein the movable core and the valve member axially reciprocate in the metal inner tubular member, and the metal inner tubular member constitutes a part of a magnetic circuit, which drives the movable core;

a drive coil arrangement that includes:

a coil which generates electromagnetic force upon energization of the coil to activate the magnetic circuit; and a bobbin around which the coil is wound; and a metal outer frame member that is arranged radially outward of the metal inner tubular member in such a manner that the drive coil arrangement is radially positioned between the metal inner tubular member and the metal outer frame member, wherein an end portion of the metal outer frame member is engaged with the metal inner tubular member to form another part of the magnetic circuit; and a resin outer cover member that at least partially covers an outer peripheral surface of the metal outer frame member which is all around the metal outer frame member, wherein the resin outer cover member is joined to and covers the coil and the metal outer frame member, wherein:

the metal inner tubular member has a step in an outer peripheral wall of the metal inner tubular member;

an axial end surface of the end portion of the metal outer frame member axially abuts against the step of the metal inner tubular member; and the end portion of the metal outer frame member is press fitted to the metal inner tubular member such that a junction between the end portion of the metal outer frame member and the metal inner tubular member is formed.

3. A fuel injection device according to claim 2, wherein the junction, which is formed by the press fitting of the end portion of the metal outer frame member to the metal inner tubular member, includes an outer peripheral surface of the metal inner tubular member and an inner peripheral surface of the end portion of the metal outer frame member, wherein the inner peripheral surface of the end portion of the metal outer frame member has a tapered surface section, which is tapered such that an inner diameter of the tapered surface section is progressively increased in an axial direction.

4. A fuel injection device according to claim 3, wherein the step of the metal inner tubular member is formed by reducing a wall thickness of a portion of a single tubular material, which is made of a compound magnetic material, relative to the rest of the single tubular material.

5. A fuel injection device according to claim 3, wherein an inner peripheral wall of the resin outer cover member, which is joined to and covers the coil and the metal outer frame member, is coaxial with an inner peripheral wall of the bobbin and an inner peripheral wall of the end portion of the metal outer frame member and has an inner diameter that allows engagement of the inner peripheral wall of the resin outer cover member to the outer peripheral surface of the metal inner tubular member.

6. A fuel injection device according to claim 1, wherein the metal outer frame member is securely engaged to the step of the metal inner tubular member, against which the axial end surface of the end portion of the metal outer frame member abuts.

7. A fuel injection device according to claim 1, wherein the end portion of the metal outer frame member protrudes radially inwardly relative to an inner peripheral surface of a portion of the resin outer cover member, which covers the metal outer frame member.

8. A fuel injection device comprising:

a metal inner tubular member that receives a movable core and a valve member, which are joined to each other, wherein the movable core and the valve member axially reciprocate in the metal inner tubular member, and the metal inner tubular member constitutes a part of a magnetic circuit, which drives the movable core;

a drive coil arrangement that includes:

a coil which generates electromagnetic force upon energization of the coil to activate the magnetic circuit; and a bobbin around which the coil is wound; and a metal outer frame member that is arranged radially outward of the metal inner tubular member in such a manner that the drive coil arrangement is radially positioned between the metal inner tubular member and the metal outer frame member, wherein an end portion of the metal outer frame member is engaged with the metal inner tubular member to form another part of the magnetic circuit; and a resin outer cover member that at least partially covers an outer peripheral surface of the metal outer frame member all which is around the metal outer frame member, wherein the resin outer cover member is joined to and covers the coil and the metal outer frame member, wherein:

the metal inner tubular member has a step in an outer peripheral wall of the metal inner tubular member;

the end portion of the metal outer frame member protrudes radially inwardly relative to an inner peripheral surface of a portion of the resin outer cover member, which covers the metal outer frame member;

the step of the metal inner tubular member is formed by radially inwardly recessing a portion of an outer peripheral surface of the metal inner tubular member away from the inner peripheral surface of the portion of the resin outer cover member; and an axial end surface of the end portion of the metal outer frame member axially abuts against the step of the metal inner tubular member in such a manner that a radial extent of the axial end surface of the end portion of the metal outer frame member at least partially overlaps with a radial extent of the step of the metal inner tubular member.

* * * * *